United States Patent [19]

Smith

[11] Patent Number: 5,014,404

[45] Date of Patent: May 14, 1991

[54] AIR ENTANGLED YARN

[76] Inventor: Kenneth M. Smith, 1702 Forest Valley Rd., Greensboro, N.C. 27410

[21] Appl. No.: 296,518

[22] Filed: Jan. 12, 1989

[51] Int. Cl.[5] ..... D02G 1/16; D02J 1/08

[52] U.S. Cl. ..... 28/271; 57/289

[58] Field of Search ..... 28/271–272, 28/273, 274, 275, 276, 258, 271; 57/334, 284, 285, 289

[56] References Cited

U.S. PATENT DOCUMENTS

| | | | |
|---|---|---|---|
| 3,099,064 | 7/1963 | Haynes | 28/258 X |
| 3,831,363 | 8/1974 | Pike | 57/289 |
| 3,940,917 | 3/1976 | Strachan | 57/157 |
| 3,955,349 | 5/1976 | Greenwood et al. | 57/285 X |
| 3,991,548 | 11/1979 | Toronyi et al. | 57/140 |
| 4,147,020 | 4/1979 | Oakes | 57/289 |
| 4,164,836 | 8/1979 | Tanae et al. | 57/289 R |
| 4,212,152 | 7/1980 | Roman | 57/207 |
| 4,437,301 | 5/1984 | Eschenbach et al. | 28/271 X |
| 4,567,720 | 2/1986 | Price | 57/207 |
| 4,596,115 | 6/1986 | Maeda et al. | 57/289 |
| 4,674,273 | 6/1987 | Clements et al. | 28/258 X |
| 4,726,180 | 2/1988 | Naylor et al. | 57/335 X |

FOREIGN PATENT DOCUMENTS

| | | | |
|---|---|---|---|
| 3182433 | 7/1988 | Japan | 28/271 |

*Primary Examiner*—Werner H. Schroeder
*Assistant Examiner*—Bradley Kurtz DeSandro
*Attorney, Agent, or Firm*—Rhodes, Coats & Bennett

[57] ABSTRACT

A technique for combining at least two unlike yarn ends to produce a composite yarn. One of the two unlike yarn ends is a spun yarn and the other of the two unlike yarn ends is a continuous multifilament yarn. The technique includes removing each of the two yarn ends from respective supply packages under predetermined tensions. The yarn ends are separated to maintain a predetermined included angle between the yarn ends. The separated yarn ends are then fed through an entangling jet to combine the yarn ends and collected on a take-up package. In the preferred embodiment, the included angle between the yarn ends varies between 3 and 17 degrees. The resulting air entangled yarn has an average number of 80 tacks per yard and an average loop size of 174 inch or less.

20 Claims, 11 Drawing Sheets

AIR ENTANGLED YARN

BACKGROUND OF THE INVENTION

1. Field of the Invention

The present invention relates generally to air entangled yarns and, in particular, to an apparatus and technique for combining natural and manmade spun yarns with continuous filament yarns and the products produced thereby.

2. Description of the Prior Art

It is well known that spun yarns formed from stable fibers may be used to produce fabrics having superior aesthetic properties such as a soft hand and a warmer appearance. However, spun yarns have limited stretchability and articles of apparel made from spun yarn alone must be made to closer tolerances in order to be comfortable to the wearer. This limitation is particularly troublesome in articles of apparel, such as men's hosiery, where it is desirable that only a limited number of sizes be produced in order to keep inventory costs low. Other yarn types are available, such as continuous multifilament stretch nylon, which possess the prerequisite stretchability. However, fabrics produced from these materials have generally not received wide consumer acceptance due to their poor "feel".

One way of producing a fabric which has the feel of spun yarns and the stretchability of continuous filament yarns has been by creating a composite yarn or fabric. A composite includes two or more yarns having complementary characteristics.

One method of producing a composite is plaiting. Plaiting involves knitting two different yarns in such a manner that one yarn becomes the face of the article and the other one the back of the article. Plated knit fabrics are particularly suitable for men's hosiery. A second method for producing a composite yarn is plying. Ply yarn is made by having two or more yarns that have been twisted together. Ply yarns may be equally wrapped about one another or one of the yarns may serve as the core and the other as an outer layer about the core. For example, core-spun sewing thread is made with a core of manmade filament yarn and covered with high quality cotton to give a strong thread with the surface and friction properties of cotton. Both of these processes are slow, high cost processes. For example, plaiting produces a large number of second quality goods due to mis-plaits when the inner yarn (for example, the nylon yarn) delivers unevenly and flips over to top. The resulting sock will be streaked after dying. In addition, ply yarns have a tendency to separate, thereby increasing the likelihood that one loop will be missed by the knitting machine and result in a defect.

On the other hand, yarns consisting of two or more continuous multifilament yarns have been produced by entangling the relative filaments about one another with jets of high velocity fluid. Samples of these yarns and the processes which produced them are shown in U.S. Pat. No. 3,940,917 issued to Strachan and U.S. Pat. No. 3,991,548 issued to Toronyi. However when continuous filament yarns and spun yarns have been combined, unstable or wild loops are formed.

One technique for eliminating these loose loops includes a process of continuously drawing the continuous filaments under controlled temperature conditions, air jet texturizing the drawn yarn, and then subjecting the textured yarn to saturated steam while restraining the yarn from shrinking during the steam treatment. An example of such a process is shown in U.S. Pat. No. 4,567,720 issued to Price. However, the process as taught by Price is directed to removing the unstable or wild loops which have already been formed in the air jet and requires a close control of the process temperatures.

As a result, air entangled continuous multifilament and spun yarns have been used primarily to produce a randomized novelty yarn which exhibit essentially no uniform characteristics. An example of such a process is shown in U.S. Pat. No. 4,212,152 issued to Roman. The Roman reference provides a particularly detailed discussion of the problems and processes for producing such novelty yarns.

It has thus become desirable to develop a process for producing a composite continuous multifilament and spun yarn which prevents the formation of unstable and wild loops which have previously plagued conventional fluid jet entangling apparatuses. The resulting yarn is suitable as a replacement for plied and plaited yarn and may be produced by a much faster process at lower costs, improved efficiency, and quality, thereby reducing the amount of second quality goods.

SUMMARY OF THE INVENTION

The present invention solves the aforementioned problems associated with the prior art by providing a technique and products thereof for producing a composite continuous multifilament and spun yarn which combines the characteristics of the spun and continuous multifilament yarns without creating unstable or wild loops as has been the case with the prior art devices. According to the present invention, the yarn ends of continuous multifilament and spun yarns are moved from the respective supply package under predetermined tensions. The two yarn ends are then passed through individual, separated yarn guides prior to entering the fluid jet. The individual yarn guides are spaced upstream from the fluid jet and with respect to one another. The distance between the individual yarn guides is adjustable. In the preferred embodiment, the spacing between the individual yarn guides is varied until the two yarn ends just merge as they enter the jet. A fluid within the jet is flowed in a direction perpendicular or slightly inclined with respect to the flow of the merged ends so as to effect intermingling along the length of the merged ends. The composite yarn exiting the fluid jet is collected on a conventional takeup package. The composite continuous multifilament and spun yarn produced according to the present invention is characterized by having the tactile and mechanical characteristics of ply yarn without the unstable or wild loops which are normally associated with conventional air jet processing.

Accordingly, one aspect of the present invention is to provide a process and apparatus for combining a continuous multifilament and spun yarn to produce a composite yarn that exhibits the complementary characteristics of continuous multifilament and spun yarns.

Another aspect of the present invention is to provide a composite yarn which is uniformly entangled along its length and which does not exhibit the unstable or wild loops which are formed by conventional air jet processing of continuous multifilament and spun yarns.

Still another aspect of the present invention is to produce a fabric from such a yarn which is particularly well-suited for articles of apparel requiring both comfort and stretchability.

These and other aspects of the present invention will be more clearly understood after a review of the following description of the preferred embodiment of the invention, when considered with the drawings.

DESCRIPTION OF THE PREFERRED EMBODIMENT

Figure 1:
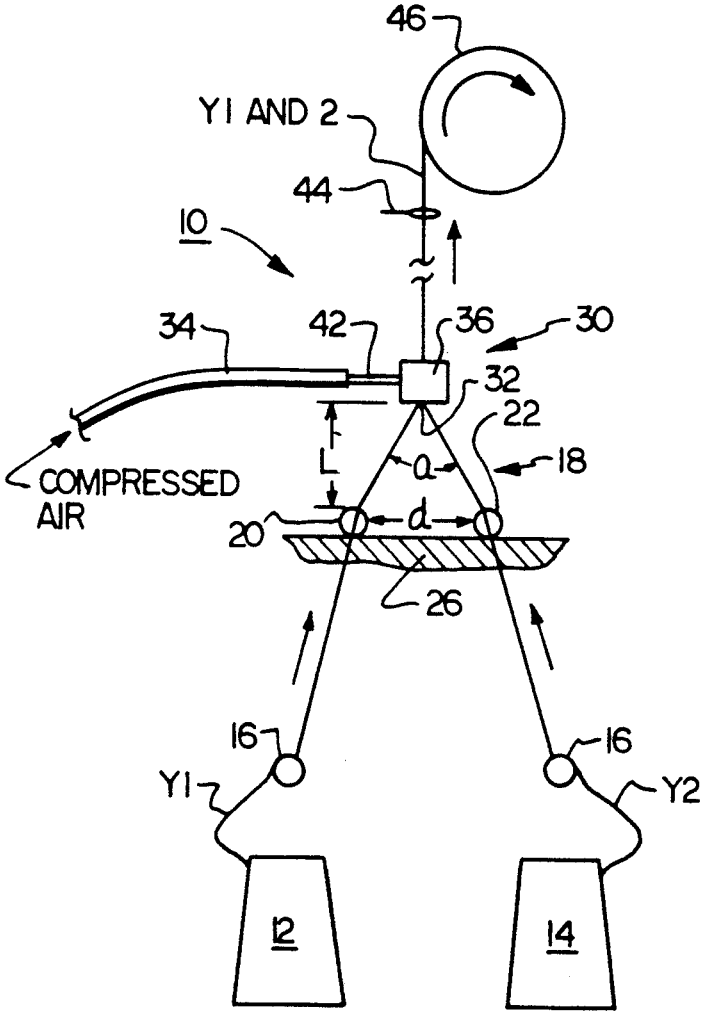
FIG. 1 is a diagrammatic representation of an apparatus for producing a composite yarn according to the present invention.

Referring now to the drawings in general, and to FIG. 1 in particular, it will be understood that the illustrations are for the purpose of describing the preferred embodiment of the invention and are not intended to limit the invention hereto.

Turning now to FIG. 1, the preferred arrangement of the apparatus, generally designated 10, is shown. Yarn supply packages 12,14 supply continuous multifilament yarn and spun yarn, respectively. Conventional tensioning devices 16 are located adjacent to the yarn supply packages 12,14 for receiving yarn ends $Y_1$ and $Y_2$ and imparting a sufficient amount of resistance to allow controlled removal of the yarn ends. A yarn guide assembly, generally designated 18, is located downstream of the tensioning devices 16. The yarn guide assembly 18 includes a first yarn guide 20 for guiding yarn end $Y_1$ and a second yarn guide 22 for guiding yarn end $Y_2$. Yarn guides 20,22 are movably mounted to a yarn guide support 26. In the preferred embodiment, the distance D between yarn guides 20,22 is preferably ½ to 1½ inches. However, the distance D may be varied in order to ensure that the yarn ends $Y_1$,$Y_2$ are apart.

A fluid jet assembly, generally designated 30, is located downstream of the yarn guide assembly 18. In the preferred embodiment, the distance L is preferably five inches. Thus in the preferred embodiment, the included angle A is approximately 2–5 degrees.

The fluid jet assembly 30 includes an entrance port 32 for receiving the yarn ends $Y_1$ and $Y_2$. Fluid jet assembly 30 also includes a fluid supply line 34 which is connected to the jet body 36 by means of adapter 42. Numerous types of interlacing jets can be used in the present process, however, in the preferred embodiment, a PS10 fluid jet manufactured by Petree & Stoudt, located in Greensboro, N.C. has produced the best results. While the PS10 is non-forwarding-type jet, it has been found that forwarding jets up to at least 10° forwarding angle can perform satisfactorily.

A third thread guide 44 is located downstream of the fluid jet assembly 30 for receiving the combined yarn ends $Y_{1+2}$ after it exits the assembly 30. The composite yarn $Y_{1+2}$ is then wound onto takeup package 46. Any of several types of textile yarn handling machines may be adapted to incorporate the present apparatus. However, one machine which is particularly well-suited is the Guidici Model TG4 texturing machine, manufactured by Davide Giudici & Figli S.N.C. located at Lecco (Como) Italy. When used for the present invention, the heated texturizing boxes normally associated with the texturizing machine are disabled.

It should be noted that the apparatus according to the present invention does not normally require any overfeed. However, a feedroll assembly (not shown) could be added downstream of the fluid jet assembly 30 to slightly overfeed the yarn to the takeup package 46 so that the density thereof can be varied depending on the type of yarn being produced as well as the type of yarn ends being combined.

The fluid jet assembly 30 is connected to a supply of compressed fluid, such as air, with the pressures of the air ranging between 30–50 psi. Maintaining the operating level of air pressure is important in achieving the proper combining effect. However, it may be varied depending upon the types of yarns combined. Samples of specific yarn combinations and process parameters are more fully described hereinafter in the description of FIGS. 2 through 19.

The takeup package 46 receives the composite yarn $Y_{1+2}$ at a speed of between 125 and 190 meters per minute with a preferred speed of approximately 125 meters per minute.

Various types of yarns can be used in the present invention including spun yarns having counts of 5 to 50/1 with fiber types including rayon, cotton, polyester, acrylics, wood and polyester cotton blends. Continuous multifilament yarns may include both nylon and polyester yarns with deniers ranging from 20 to 200 and either one or two ply or multiple ply.

A further understanding of the present invention can be had from consideration of the following examples corresponding to FIGS. 2 through 19 which are set forth to illustrate certain preferred embodiments.

The table shown below provides a summarized comparison of the visual appearance of FIGS. 2 through 19. Details concerning the various yarns being combined and the critical process and apparatus variables are set forth therein. In addition, critical product characteristics including stretch per yard, number of tacks per yard and the presence and size of slubs or loops are also summarized.

| FIGS. | Yarns | Takeup Speed | Tension Between Supply & Jet | Feed Geometry | Jet Geometry | Jet PSI | Tack per Yd | Stretch Per Yd | Slubs | Loop Size |
|---|---|---|---|---|---|---|---|---|---|---|
| 2–3 | 20/1 Spun Polyester 100d/34 Filament Stretch Nylon (S-Torque) | 125–190 mpm | 0–20 g | Fed Together | 0.08" est. | 30 | 10 | 1¼" | — | 2–3" |
| 4–5 | 20/1 Spun Polyester 100d/34 Filament Stretch Nylon (S-torque) | Same | Same | Same | 0.08" est. | 50 | 48 | 1¼" | — | 1" |
| 6–7 | 20/1 Spun Polyester 74d/34 Filament Stretch Nylon (S-torque) | Same | Same | Same | 0.08" est. | 40 | 24 | 1¼" | — | 2–3" |
| 8–9 | 20/1 Spun Rayon 2 ply 70d/ 34 Filament Stretch Nylon | Same | Same | Same | .062" (10" Forwarding) | 40 | 50 | 1¼" | — | ½" |
| 10–11 | 20/1 Spun Polyester 2 ply 70d/ 34 Filament Stretch Nylon | Same | Tension lower on spun | Same | Same | 50 | 70 | 1¼" | Yes | ¼" |
| 12–13 | 20/1 Spun Rayon 2 ply 70d/ 34 Filament Stretch Nylon | Same | 0–20 g | Fed Separately | Same | 40 | 80 | 1¼" | — | ¼" |
| 14–15 | 20/1 Spun Polyester 2 ply 70d/ 34 Filament Stretch Nylon | Same | Same | Same | Same | 40 | 80 | 1¼" | — | ¼" |
| 16–17 | 20/1 Spun Rayon 2 ply 70d/ 34 Filament Stretch Nylon | Same | Same | Same | .062" (Non-forwarding) | 40 | 80–85 | 1¼" | — | <¼" |
| 18–19 | 20/1 Spun Polyester 2 ply 70d/ 34 Filament Stretch Nylon | Same | Same | Same | Same | 45 | 90 | 1¼" | — | 0 |

Figure 2:
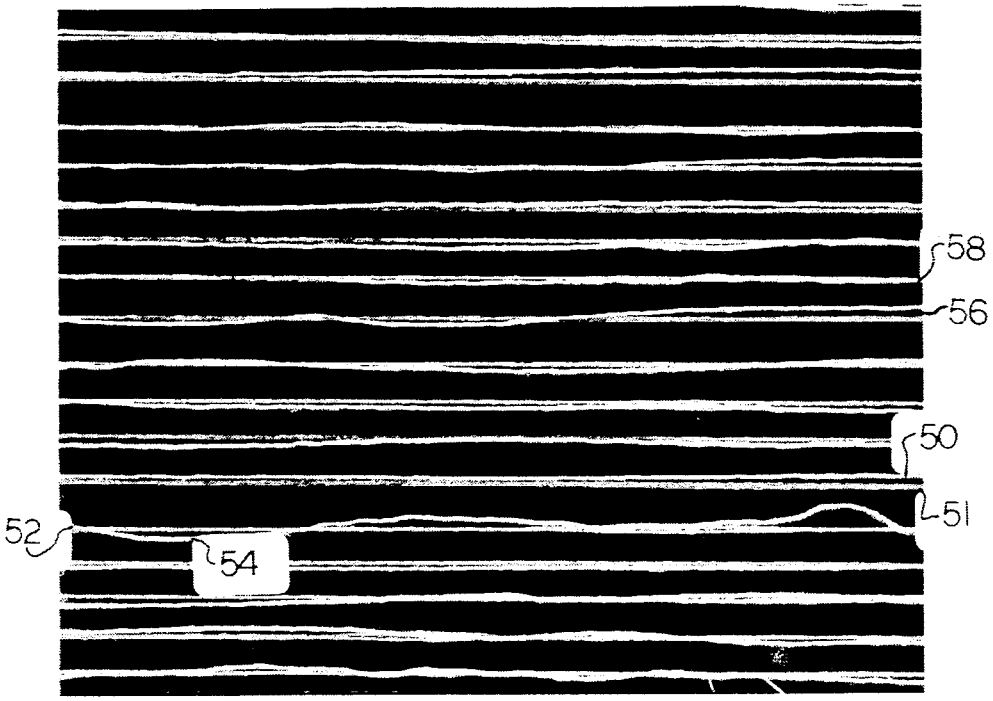
FIG. 2 is a photograph of a composite yarn comprised of 100 d/34 filament continuous multifilament stretch nylon and 20/1 spun polyester.
Figure 3:
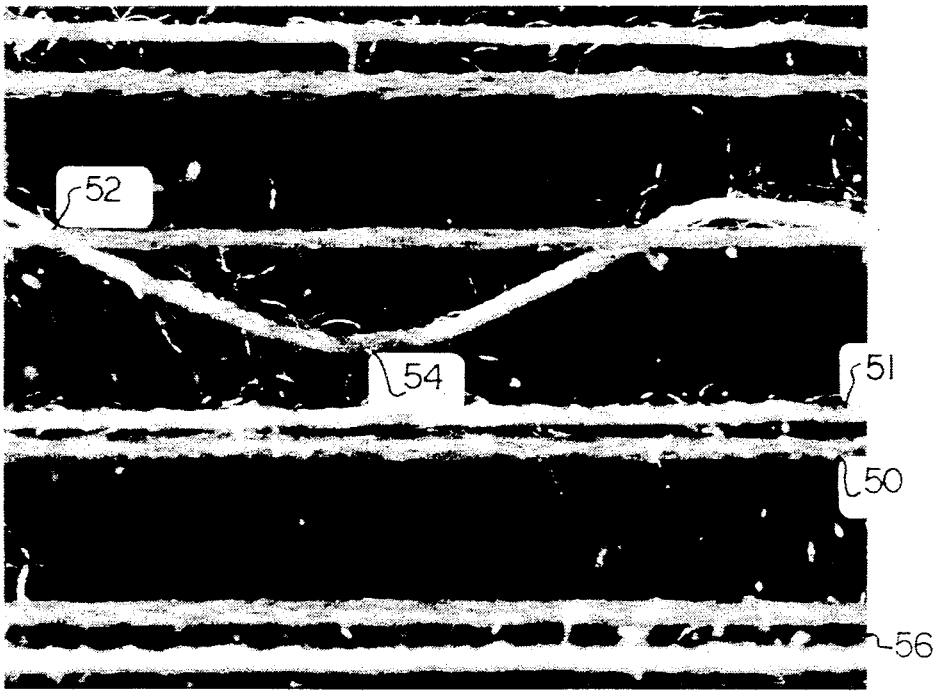
FIG. 3 is a photograph enlarging a segment of the yarn shown in FIG. 2 to a 10 x size.

Turning first to FIGS. 2 and 3, the composite yarn (Example 1) was produced from a 100 denier/34 filament stretch nylon (S-torque) 50 and a 20/1 spun polyesters. The takeup speed varied between 125–190 meters per minute with a preferred speed of approximately 140 meters per minute. The tension between the yarn supplies and the fluid jet varied between 0–20 grams. In Example 1, the feed geometry was configured such that the yarns were fed together prior to entering the fluid jet. The fluid jet geometry included an entrance orifice size of approximately 0.08 inches and an operational pressure of approximately 30 psi.

The tack frequency of the resulting yarn averaged approximately 10 tacks per yard. The stretch per yard of the yarns was approximately 1¼ inches. No slubs were present, however, the loops size varied between 2–3 inches. This yarn would be unacceptable yarn for producing knitted stretch socks since the loop size is sufficiently large to cause defects to be produced when the needles miss one of the two loops.

The composite yarn in Example 1 exhibits areas where the two yarns cross over and are tacked together, such as shown at 52 in FIGS. 2 and 3. In addition, there are areas in this yarn in which loops 54 are formed, and other areas where the yarns exhibit a parallel relationship as at 56. There are still other spaces where the yarns appear to be plied together as at 58.

Figure 4:
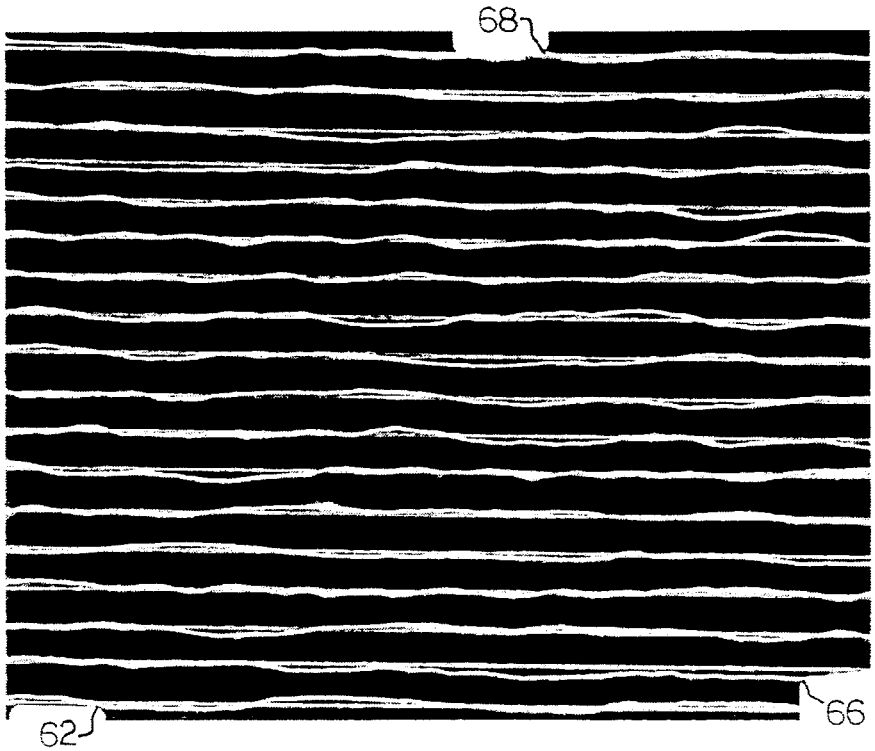
FIG. 4 is a photograph of a composite yarn also comprised of 100 d/34 filament continuous multifilament stretch nylon and 20/1 spun polyester.
Figure 5:
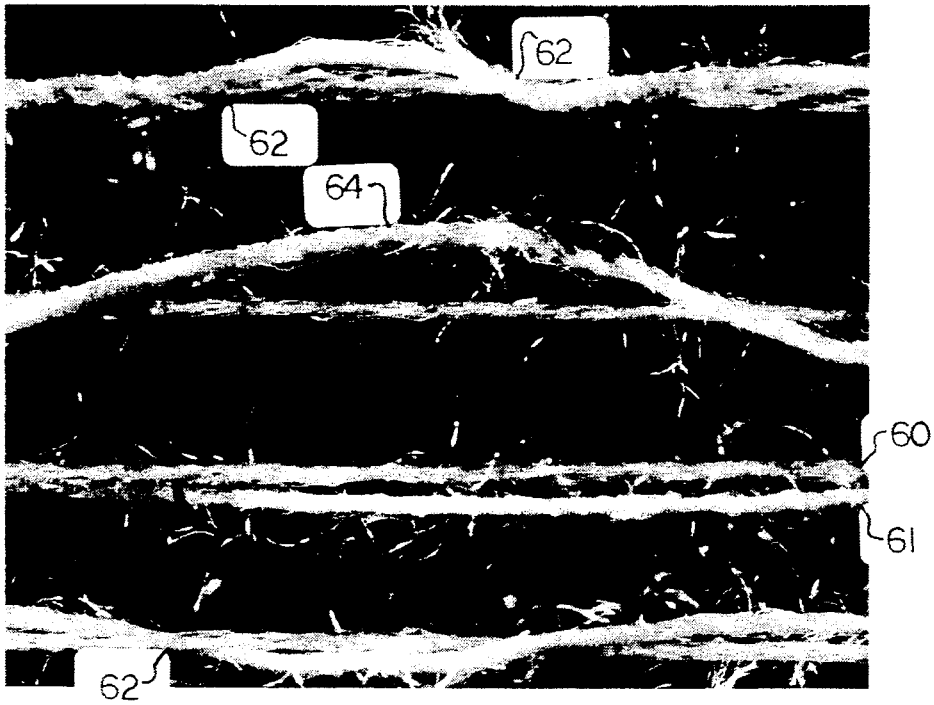
FIG. 5 is a photograph enlarging a segment of the yarn shown in FIG. 4 to a 10 x size.

Turning next to FIGS. 4 and 5, the composite yarn (Example 2) also was produced from a 100 denier/34 filament stretch nylon (S-torque) 60 and a 20/1 spun polyester 61. The takeup speed varied between 125–190 meters per minute with a preferred speed of approximately 125 meters per minute. The tension between the yarn supplies and the fluid jet varied between 0–20 grams. In Example 2, the feed geometry also was configured such that the yarns were fed together prior to entering the fluid jet. The fluid jet geometry included an orifice size of approximately 0.08 inches and an operational pressure of approximately 30 psi.

The tack frequency of the resulting yarn averaged approximately 48 tacks per yard. The stretch per yard of the yarns was approximately 1¼ inches. No slubs were present, however, the loop size was approximately 1 inch. This would be unacceptable yarn for producing knitted stretch socks since the loop size is still sufficiently large to cause defects to be produced when the needles miss one of the two loops.

The composite yarn in Example 2 exhibits areas where the two yarns cross over and are tacked together, such as shown at 62 in FIGS. 4 and 5. In addition, there are areas in this yarn in which loops 64 are formed, and other areas where the yarns exhibit a parallel relationship as at 66. There are still other spaces where the yarns appear to be plied together as at 68.

Figure 6:
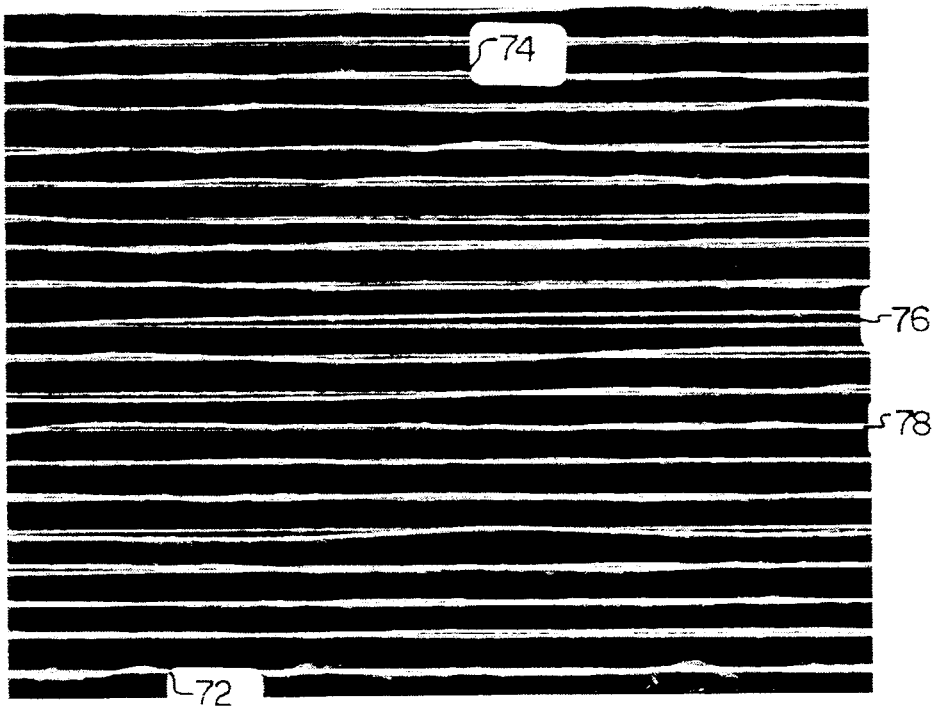
FIG. 6 is a photograph of a composite yarn comprised of 74 d/34 filament continuous multifilament stretch nylon and 20/1 spun polyester.
Figure 7:
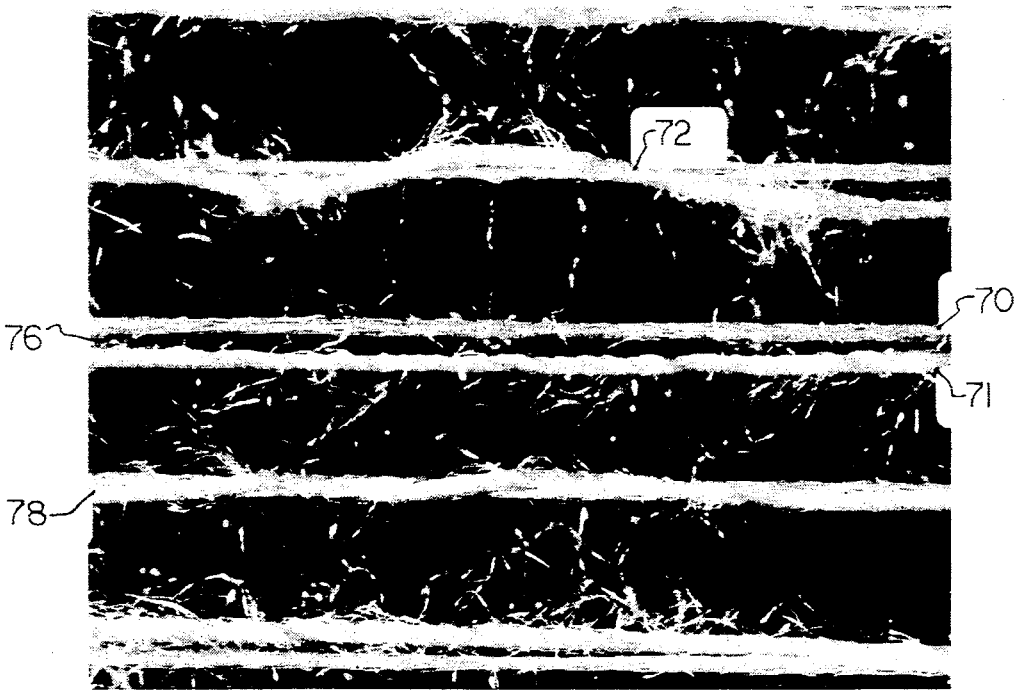
FIG. 7 is a photograph enlarging a segment of the yarn shown in FIG. 6 to a 10 x size.

Turning next to FIGS. 6 and 7, the composite yarn (Example 3) was produced from a 70 denier/34 filament stretch nylon (S-torque) 70 and a 20/1 spun polyester 71. The takeup speed varied between 125–190 meters per minute with a preferred speed of approximately 125 meters per minute. The tension between the yarn supplies and the fluid jet varied between 0–20 grams. In Example 3, the feed geometry was configured such that the yarns were fed together prior to entering the fluid jet. The fluid jet geometry included an orifice size of approximately 0.08 inches and an operational pressure of approximately 40 psi. The tack frequency of the resulting yarn averaged only approximately 24 tacks per yard. The stretch per yard of the yarns was approximately 1¼ inches. No slubs were present, however, the loops size varied between 2–3 inches. This would be unacceptable yarn for producing knitted stretch socks since the loop size is sufficiently large to cause defects to be produced when the needles miss one of the two loops.

The composite yarn in Example 3 exhibits areas where the two yarns cross over and are tacked together, such as shown at 72 in FIGS. 6 and 7. In addition, there are areas in this yarn in which loops 74 are formed, and other areas where the yarns exhibit a parallel relationship as at 76. There are still other spaces where the yarns appear to be plied together as at 78.

Figure 8:
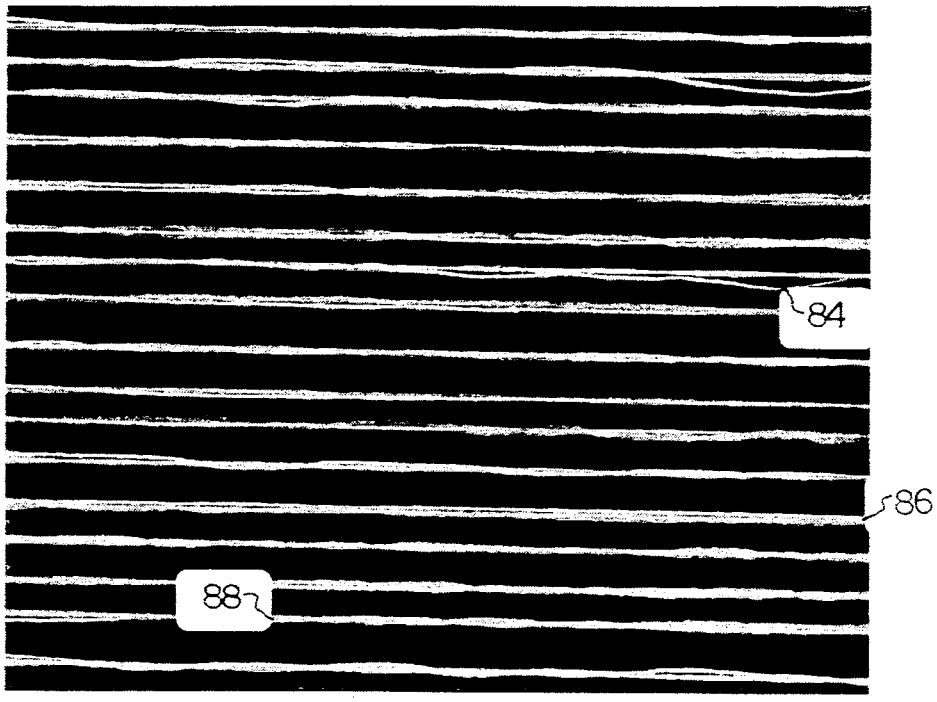
FIG. 8 is a photograph of a composite yarn comprised of 2 ply 70 d/34 filament continuous multifilament stretch nylon and 20/1 spun polyester.
Figure 9:
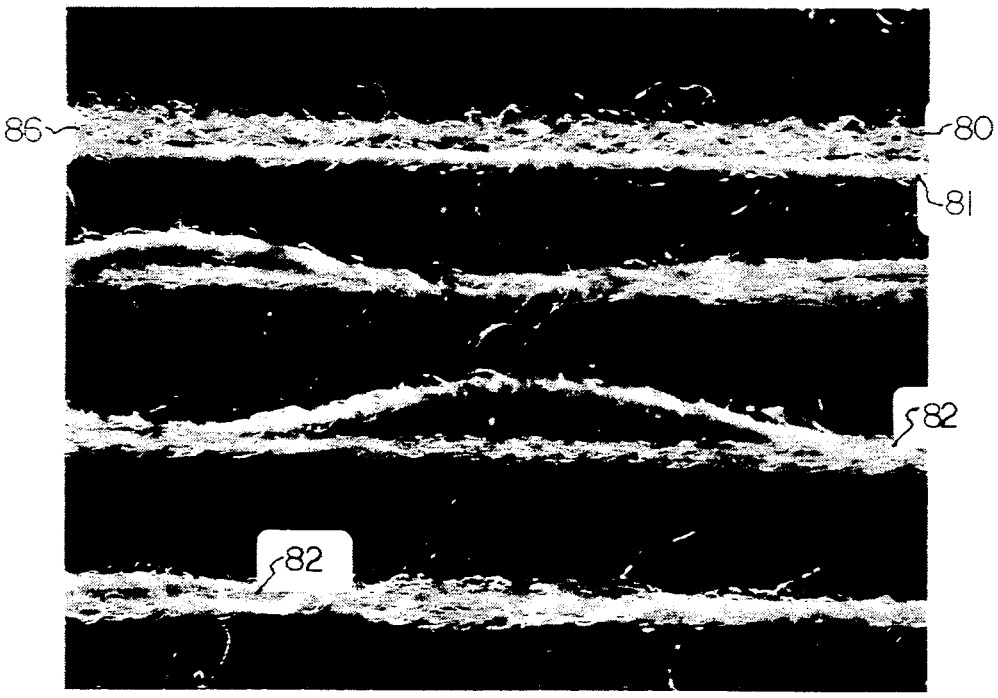
FIG. 9 is a photograph enlarging a segment of the yarn shown in FIG. 8 to a 10 x size.

Turning now to FIGS. 8 and 9, the composite yarn (Example 4) was produced from a 2 ply 70 denier/34 filament stretch nylon 80 and a 20/1 spun rayon 81. The takeup speed varied between 125–190 meters per minute with a preferred speed of approximately 125 meters per minute. The tension between the yarn supplies and the fluid jet varied between 0–20 grams. In Example 4, the feed geometry was configured such that the yarns were fed together prior to entering the fluid jet. The fluid jet geometry included an orifice size of approximately 0.062 inches (10° forwarding) and an operational pressure of approximately 40 psi.

The tack frequency of the resulting yarn averaged approximately 50 tacks per yard. The stretch per yard of the yarns was approximately 1¼ inches. No slubs were present and the loop size was approximately ½ inch. This would be a marginally acceptable yarn for producing knitted stretch socks since the loop size may still be sufficiently large to cause defects to be produced when the needles miss one of the two loops.

The composite yarn in Example 4 exhibits areas where the two yarns cross over and are tacked together, such as shown at 82 in FIGS. 8 and 9. In addition, there are areas in this yarn in which loops 84 are formed, and other areas where the yarns exhibit a parallel relationship as at 86. There are still other spaces where the yarns appear to be plied together as at 88.

Figure 10:
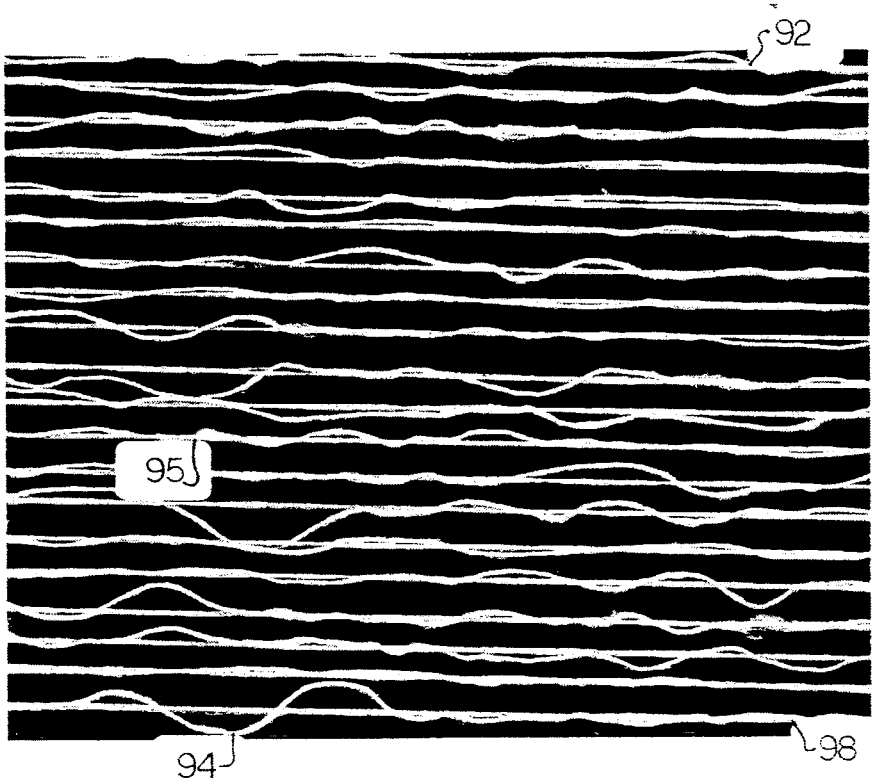
FIG. 10 is a photograph of a composite yarn comprised of 2 ply 70 d/34 filament continuous multifilament stretch nylon and 20/1 spun polyester.
Figure 11:
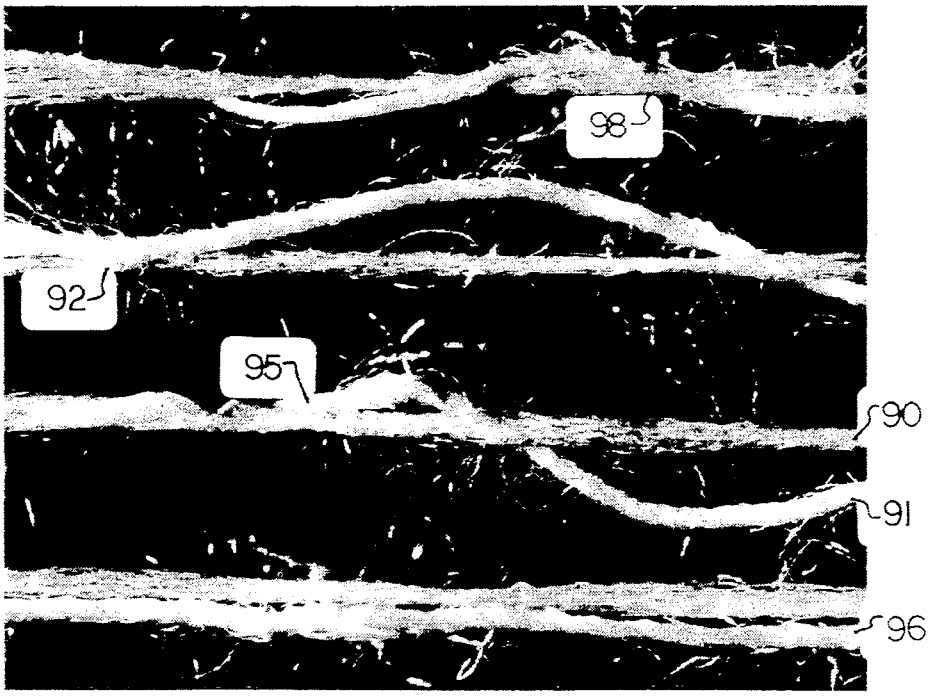
FIG. 11 is a photograph enlarging a segment of the yarn shown in FIG. 10 to a 10 x size.

Turning next to FIGS. 10 and 11, the composite yarn (Example 5) was produced from a 2 ply 70 denier/34 filament stretch nylon 90 and a 20/1 spun polyester 91. The takeup speed varied between 125–190 meters per minute with a preferred speed of approxi-mately 125 meters per minute. The tension between the yarn supplies and the fluid jet varied between 0–20 grams. However, the tension on the spun yarn was lower. In Example 5, the feed geometry was configured such that the yarns were fed together prior to entering the fluid jet. The fluid jet geometry included an orifice size of approximately 0.062 inches and an operational pressure of approximately 50 psi.

The tack frequency of the resulting yarn averaged approximately 70 tacks per yard. The stretch per yard of the yarns was approximately 1¼ inches. Slubs 95 were present, however, while numerous, the loop size was only about ¼ inch. This would be unacceptable yarn for producing knitted stretch socks since loops size are sufficiently large to cause defects to be produced when the needles miss one of the two loops. However, it could be useful as a novelty yarn.

The composite yarn in Example 5 exhibits areas where the two yarns cross over and are tacked together, such as shown at 92 in FIGS. 10 and 11. In addition, there are areas in this yarn in which loops 94 are formed, and other areas where the yarns exhibit a parallel relationship as at 96. There are still other spaces where the yarns appear to be plied together as at 8.

Figure 12:
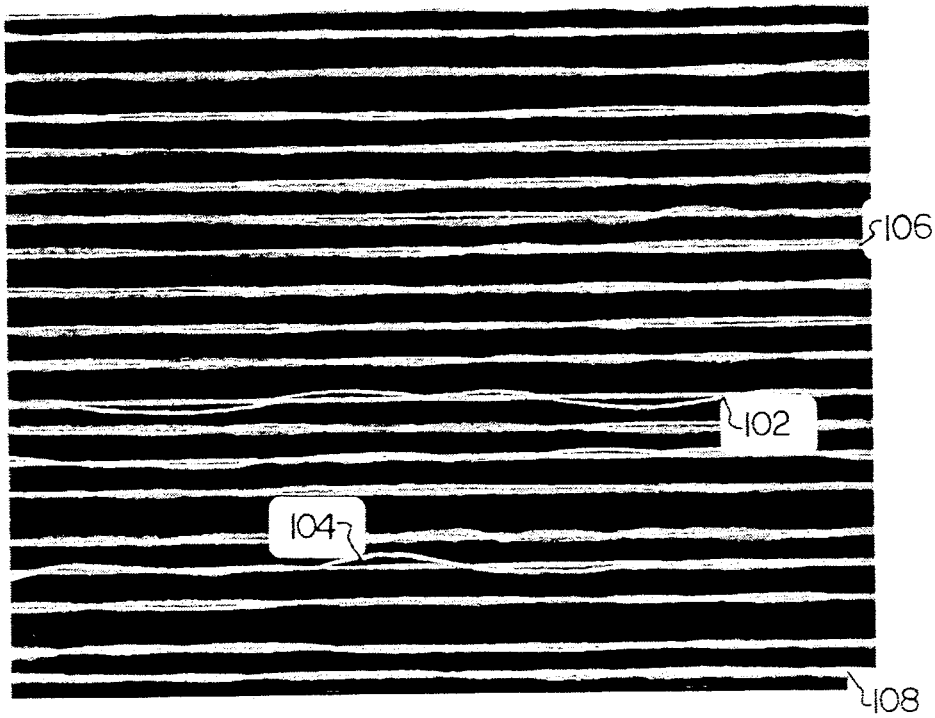
FIG. 12 is a photograph of a composite yarn comprised of 2 ply 70 d/34 filament continuous multifilament stretch nylon and 20/1 spun rayon.
Figure 13:
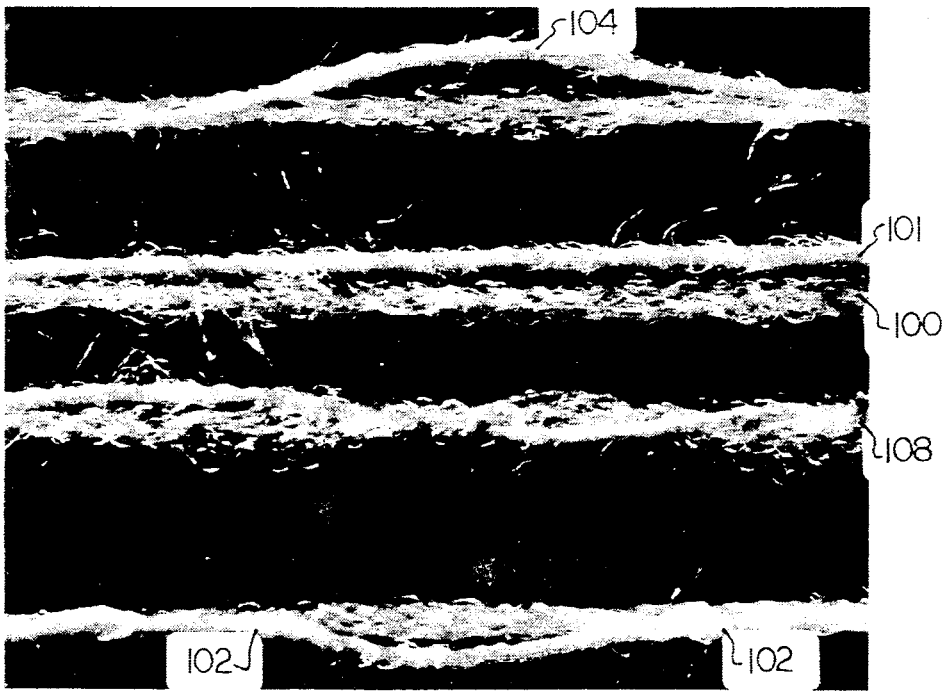
FIG. 13 is a photograph enlarging a segment of the yarn shown in FIG. 12 to a 10 x size.

Turning now to FIGS. 12 and 13, the composite yarn (Example 6) was produced from a 2 ply 70 denier/34 filament stretch nylon 100 and a 20/1 spun rayon 101. The takeup speed varied between 125–190 meters per minute with a preferred speed of approximately 125 meters per minute. The tension between the yarn supplies and the fluid jet varied between 0–20 grams. In Example 6, the feed geometry was configured such that the yarns were fed separately prior to entering the fluid jet. The fluid jet geometry included an orifice size of approximately 0.062 inches and operational pressure of approximately 40 psi.

The tack frequency of the resulting yarn averaged approximately 80 tacks per yard. The stretch per yard of the yarns was approximately 1¼ inches. No slubs were present and the loop size was about ¼ inch. This would be an acceptable yarn for producing knitted stretch socks since the loop size is sufficiently small to prevent defects produced when the needles miss one of the two loops.

The composite yarn in Example 6 exhibits areas where the two yarns cross over and are tacked together, such as shown at 102 in FIGS. 12 and 13. In addition, there are areas in this yarn in which loops 104 are formed, and a small number of other areas where the yarns exhibit a parallel relationship as at 106. There are still other spaces where the yarns appear to be plied together as at 108.

Figure 14:
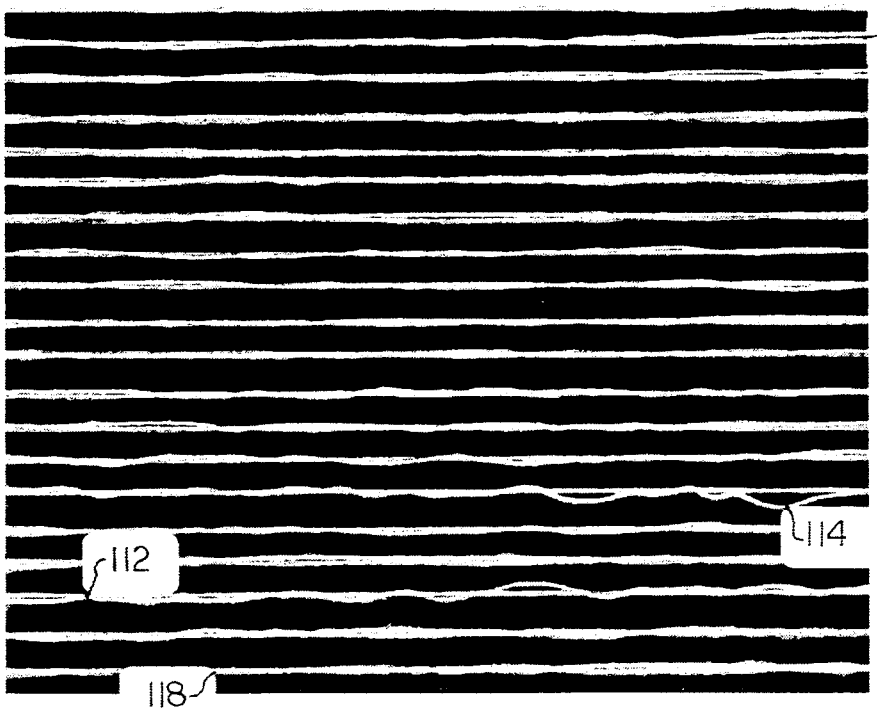
FIG. 14 is a photograph of a composite yarn comprised of 2 ply 70 d/34 filament continuous multifilament stretch nylon and 20/1 spun polyester.
Figure 15:
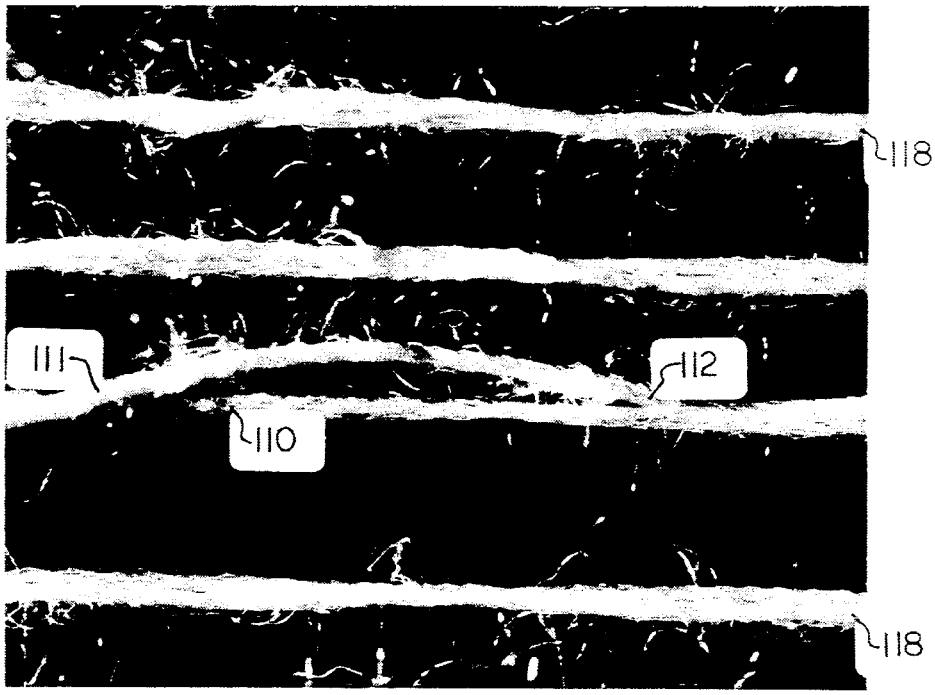
FIG. 15 is a photograph enlarging a segment of the yarn shown in FIG. 14 to a 10 x size.

Turning next to FIGS. 14 and 15, the composite yarn (Example 7) was produced from a 2 ply 70 denier/34 filament stretch nylon 110 and a 20/1 spun polyester. The takeup speed varied between 125–190 meters per minute with a preferred speed of approximately 125 meters per minute. The tension between the yarn supplies and the fluid jet varied between 0–20 grams. In Example 7, the feed geometry was configured such that the yarns were fed separately prior to entering the fluid jet. The fluid jet geometry included an orifice size of approximately 0.062 inches and an operational pressure of approximately 40 psi.

The tack frequency of the resulting yarn averaged approximately 80 tacks per yard. The stretch per yard of the yarns was approximately 1¼ inches. No slubs were present and the loop size was about ¼ inch. This would be an acceptable yarn for producing knitted stretch socks since the loop size is sufficiently small to prevent defects.

The composite yarn in Example 7 exhibits areas where the two yarns cross over and are tacked together, such as shown at 112 in FIGS. 14 and 15. In addition, there are areas in this yarn in which loops 114 are formed, and a small number of other areas where the yarns exhibit a parallel relationship as at 116. There are still other spaces where the yarns appear to be plied together as at 118.

Figure 16:
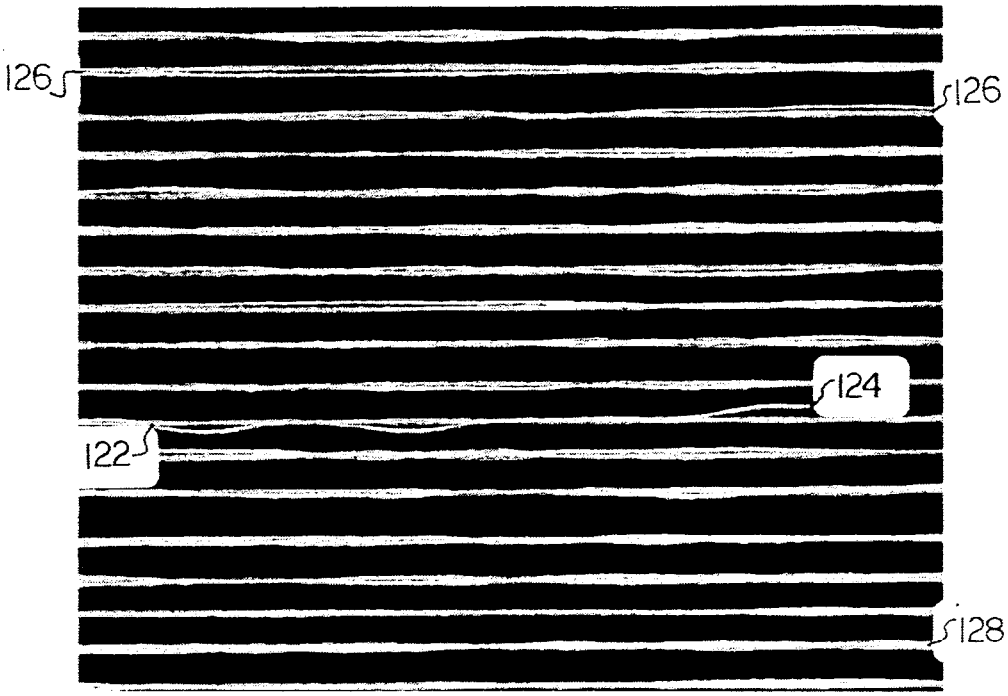
FIG. 16 is a photograph of a composite yarn comprised of 2 ply 70 d/34 filament continuous multifilament stretch nylon and 20/1 spun rayon.
Figure 17:
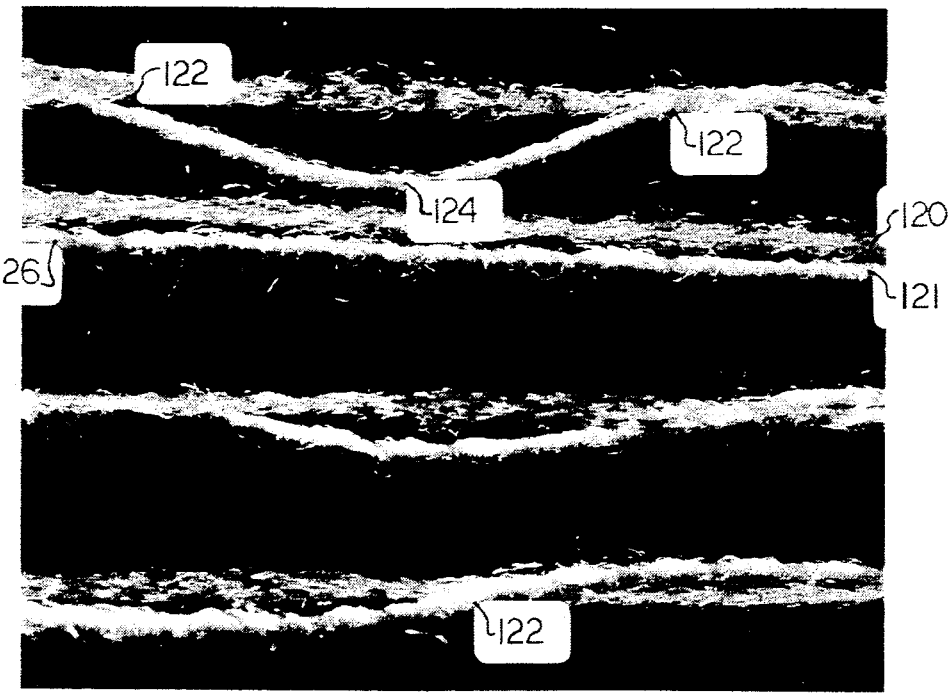
FIG. 17 is a photograph enlarging a segment of the yarn shown in FIG. 16 to a 10 x size.

Turning now to FIGS. 16 and 17, the composite yarn (Example 8) was produced from a 2 ply 70 denier/34 filament stretch nylon 120 and a 20/1 spun rayon 121. The takeup speed varied between 125–190 meters per minute with a preferred speed of approximately 125 meters per minute. The tension between the yarn supplies and the fluid jet varied between 0–20 grams. In Example 8, the feed geometry also was configured such that the yarns were fed separately prior to entering the fluid jet. The fluid jet geometry included an orifice size of approximately 0.062 inches and an operational pressure of approximately 40 psi.

The tack frequency of the resulting yarn averaged approximately 80–85 tacks per yard. The stretch per yard of the yarns was approximately 1¼ inches. No slubs were present and the loop size was less than ¼ inch. This would be a more acceptable yarn than Examples 6 and 7 for producing knitted stretch socks since the loop size is more than small enough to prevent defects produced when the needles miss one of the two loops.

The composite yarn in Example 8 exhibits areas where the two yarns cross over and are tacked together, such as shown at 122 in FIGS. 16 and 17. In addition, there are areas in this yarn in which loops 124 are formed, and other areas where the yarns exhibit a parallel relationship as at 126. There are still other spaces where the yarns appear to be plied together as at 128.

Figure 18:
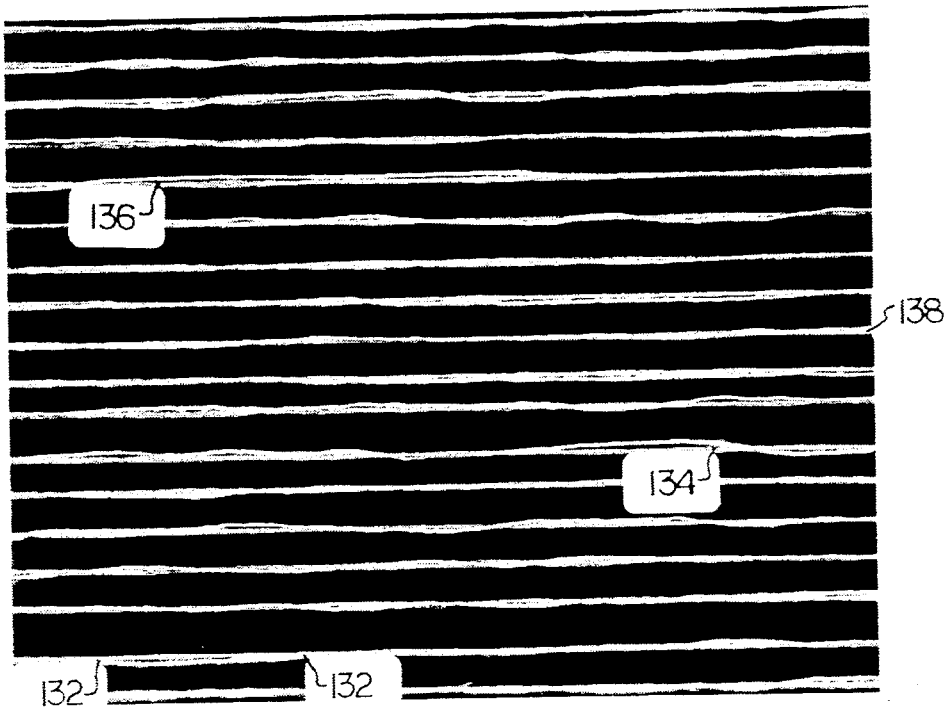
FIG. 18 is a photograph of a composite yarn comprised of 2 ply 70 d/34 filament continuous multifilament stretch nylon and 20/1 spun polyester.
Figure 19:
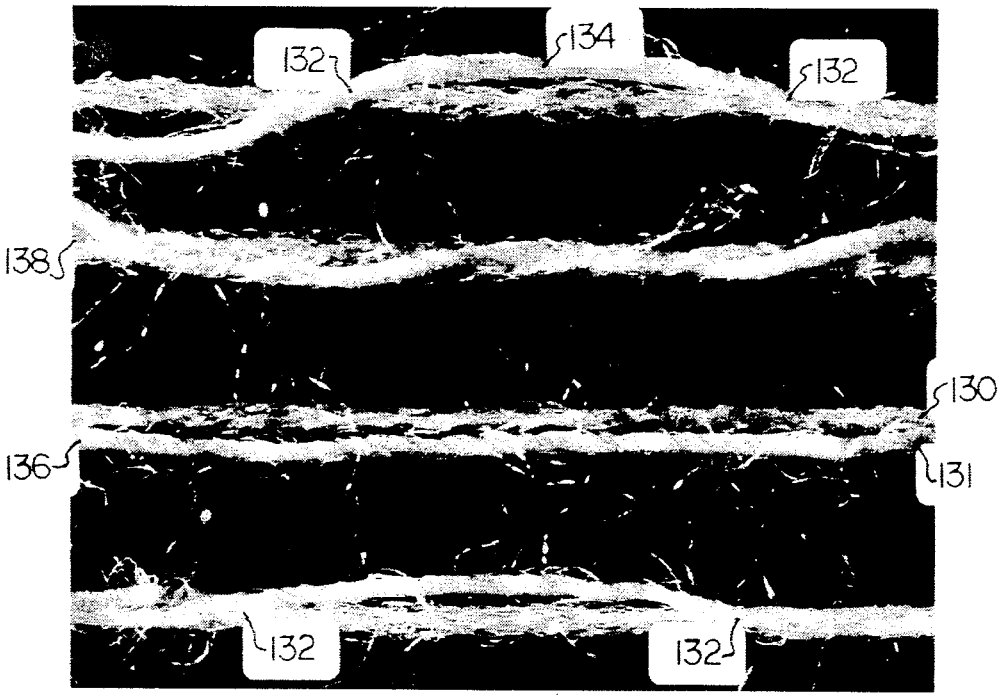
FIG. 19 is a photograph enlarging a segment of the yarn shown in FIG. 18 to a 10 x size.

Turning finally to FIGS. 18 and 19, the composite yarn (Example 9) was produced from a 2 ply 70 denier/34 filament stretch nylon 130 and a 20/1 spun polyester 131. The takeup speed varied between 125–190 meters per minute with a preferred speed of approximately 125 meters per minute. The tension between the yarn supplies and the fluid jet varied between 0–20 grams. In Example 9, the feed geometry also was configured such that the yarns were fed separately prior to entering the fluid jet. The fluid jet geometry also included an orifice size of approximately 0.062 inches (non-forwarding) and the operational pressure was increased slightly to approximately 45 psi.

The tack frequency of the resulting yarn averaged approximately 90 tacks per yard. The stretch per yard of the yarns was approximately 1¼ inches. No slubs were present and the loop size appeared to be zero to the naked eye. This is the most acceptable yarn for producing knitted stretch socks since the loops are practically non-existent.

The composite yarn in Example 9 exhibits areas where the two yarns cross over and are tacked together, such as shown at 132 in FIGS. 18 and 19. In addition, there are areas in this yarn in which loops 134 are formed, and other areas where the yarns exhibit a parallel relationship as at 136. There are still other spaces where the yarns appear to be plied together as at 138.

Figure 20:
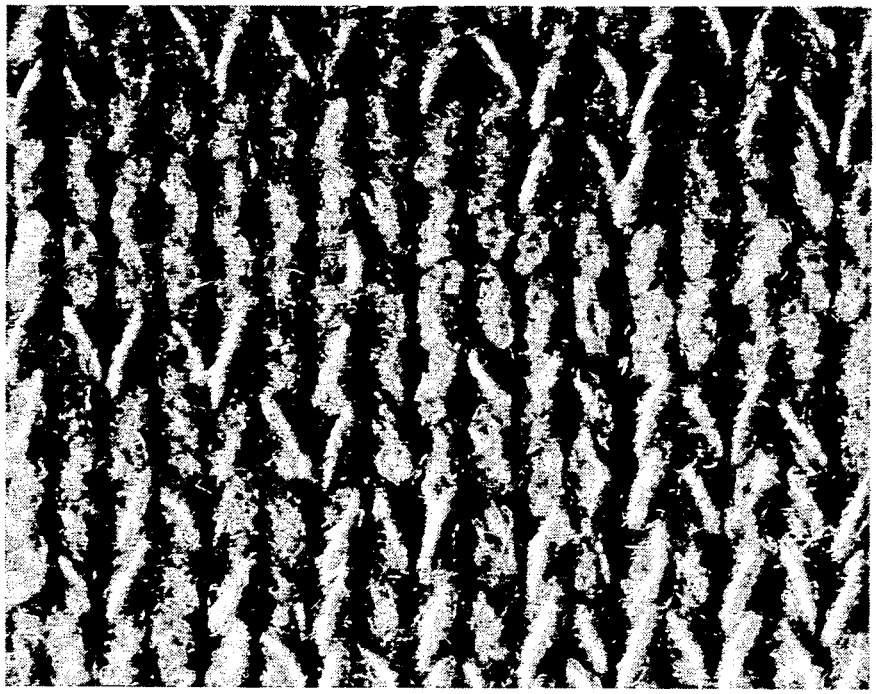
FIG. 20 is a photograph of a fabric knit from the composite yarn shown in FIGS. 18 and 19, enlarged to a 10 x size.

FIG. 20 is a photograph of a piece of fabric knit from a composite yarn comprised of a spun polyester yarn and a stretch nylon similar to Example 9 and described in FIGS. 18 and 19 above. The fabric shown in FIG. 20 demonstrates that a knit fabric knit from a yarn produced according to the present invention results in the formation of the fabric that has generally uniform surface characteristics therein.

Certain modifications and improvements would occur to those skilled in the art in reading of the foregoing description. By way of example, yarn sizes could be varied beyond the limits specified and various other fibers, such as acrylics, could be used and still produce the above described effect. Furthermore, changes, such as takeup speed and tension, may also require changes in the jet geometry and air pressure which would be within the ordinary skill in the art. It should be understood that all such modifications and improvements have been deleted herein for the sake of preciseness and readability but are probably within the scope of the following claims.

I claim:

1. A method of combining at least two unlike yarn ends, at least one of said yarn ends being a spun yarn and at least one of said yarn ends being a continuous multifilament yarn, to produce a composite yarn, comprising the steps of:

(a) removing each of the two yarn ends from respective supply packages under predetermined tensions at substantially the same speed;

(b) separating the yarn ends to maintain a predetermined included angle between the yarn ends;

(c) feeding the separated yarn ends substantially straight through an entangling jet to combine the yarn ends, the centerline of said jet falling within said predetermined included angle; and (d) collecting the entangled yarn ends on a takeup package.

2. The method according to claim 1, wherein the yarn ends are merged adjacent to the entrance of the entangling yet.

3. The method according to claim 2, wherein the included angle between the yarn ends is greater than zero degrees.

4. The method according to claim 3, wherein the included angle between the yarn ends varies between 3 and 17 degrees.

5. The method according to claim 1, further including flowing a fluid within the jet in a direction substantially perpendicular to the direction of flow of the yarn ends.

6. The method according to claim 5, wherein the fluid flowing through the jet is air supplied at pressures varying between 30 and 50 psi.

7. The method according to claim 6, wherein the pressure of the air is preferably about 45 psi.

8. The method according to claim 6, wherein the speed at which the yarn is traveling varies between 125 and 190 meters per minute.

9. The method according to claim 8, wherein the preferred yarn speed is 125 meters per minute.

10. An apparatus for combining at least two unlike yarn ends, at least one of said yarn end being a spun yarn and at least one of said yarn ends being a continuous multi-filament yarn, to produce a composite yarn, comprising:

(a) means for supplying each of the two yarn ends from respective supply packages under predetermined tensions at substantially the same speed;

(b) a yarn guide assembly for receiving and separating the yarn ends to maintain a predetermined included angle between the yarn ends;

(c) an entangling jet located substantially straight downstream of said yarn guide assembly for receiving the separate yarn ends from said yarn guide assembly and combining the yarn ends, the centerline of said jet falling within said predetermined included angle; and (d) means for collecting the entangled yarn ends on a take-up package.

11. The apparatus according to claim 10, wherein said yarn guide assembly includes a yarn guide support having a plurality of yarn guides mounted thereto, said yarn guides being substantially equidistant from the entrance of said entangling jet.

12. The apparatus according to claim 11, wherein said yarn guides are moveably mounted with respect to one another to permit the adjustment of said included angle.

13. The apparatus according to claim 12, wherein the included angle between the yarn ends is greater than zero degrees.

14. The apparatus according to claim 13, wherein the included angle between the yarn ends varies between 3 and 17 degrees.

15. The apparatus according to claim 10, wherein said jet is operable to flow a fluid within the jet in a direction substantially perpendicular to the direction of flow of the yarn ends.

16. The apparatus according to claim 15, wherein the fluid flowing through the jet is air supplied at pressures varying between 30 and 50 psi.

17. The apparatus according to claim 16, wherein the pressure of the air is preferably about 45 psi.

18. The apparatus according to claim 10, wherein the speed at which the yarn is traveling varies between 125 and 190 meters per minute.

19. The apparatus according to claim 18, wherein the preferred yarn speed is 125 meters per minute.

20. A yarn produced according to the process of claim 1.

* * * * *